United States Patent [19]

Gault

[11] 4,062,640

[45] Dec. 13, 1977

[54] METHOD AND MEANS FOR CONTROLLING LONG STROKE PUMPING UNITS

[75] Inventor: Robert H. Gault, Midland, Tex.

[73] Assignee: Bethlehem Steel Corporation, Bethlehem, Pa.

[21] Appl. No.: 726,387

[22] Filed: Sept. 24, 1976

[51] Int. Cl.[2] ..... F04B 35/04

[52] U.S. Cl. ..... 417/415; 74/89.22; 74/589; 166/72; 254/178; 254/184

[58] Field of Search ..... 417/12, 44, 410, 415; 74/89.22, 589; 166/72, 68, 68.5; 73/151; 254/178, 184

[56] References Cited

U.S. PATENT DOCUMENTS

| | | | |
|---|---|---|---|
| 146,675 | 8/1872 | Holwell | 254/178 |
| 224,862 | 2/1880 | Bigelow | 254/145 |
| 252,966 | 1/1882 | Pierce | 254/178 |
| 514,262 | 2/1894 | Denton | 254/178 |
| 574,085 | 12/1896 | Denton | 254/178 |
| 576,316 | 2/1897 | Hunt | 254/178 |
| 871,687 | 11/1907 | Frink | 254/178 |
| 929,508 | 7/1909 | Smith | 254/178 |
| 1,403,021 | 1/1922 | Fogal | 254/178 |
| 1,650,936 | 11/1927 | McLauthlin et al. | 254/178 |
| 1,739,724 | 12/1929 | Lake | 73/151 |
| 1,928,532 | 9/1933 | Gillespie | 254/178 |
| 1,970,596 | 8/1934 | Coberly | 254/178 |
| 2,196,816 | 4/1940 | Saxe | 74/589 |
| 2,370,029 | 2/1945 | Gillespie | 254/185 |
| 3,248,958 | 5/1966 | Bender | 74/89.22 |
| 3,285,081 | 11/1966 | Kuhns et al. | 74/89.22 |
| 3,343,709 | 9/1967 | Gibbs | 73/151 |
| 3,528,305 | 9/1970 | Kuhns et al. | 74/89.22 |
| 3,640,342 | 2/1972 | Gault | 166/72 |
| 3,695,117 | 10/1972 | Ewing et al. | 74/89.22 |
| 3,778,694 | 12/1973 | Hubby et al. | 417/44 |
| 3,851,995 | 12/1974 | Mills | 417/12 |
| 3,868,820 | 3/1975 | Lawson | 74/89.2 |
| 3,998,568 | 12/1976 | Hynd | 417/12 |

*Primary Examiner*—C. J. Husar

*Attorney, Agent, or Firm*—Joseph J. O'Keefe; Charles A. Wilkinson

[57] ABSTRACT

In a rotating drum or winch type long stroke pumping unit in which the motor which powers the pumping unit operates only during the central portion of the pumping stroke, the motor is energized at the point of maximum load upon the pumping string during the upstroke and the point of minimum load on the downstroke. By precisely coordinating the energization of the motor with the load upon the pumping string detrimental oscillations in the pumping string are damped out.

9 Claims, 10 Drawing Figures

WAVEFORM DIAGRAMS

METHOD AND MEANS FOR CONTROLLING LONG STROKE PUMPING UNITS

BACKGROUND OF THE INVENTION

In oil well pumping, a string of sucker rods, or occasionally a long flexible pumping strand, or cable, which extends down the oil well tubing within the well casing is used to stroke a pump at the bottom of the oil well. On the upstroke, fluid in the well is lifted and the basic load consists of the weight of the string of pumping rods plus the weight of the fluid in the well. Dynamic loads are also imposed on the rod string and fluids by the motion of the rod string.

While the component sucker rods or pumping strand are formed from high strength steel they have a certain elasticity and in a deep well the cumulative elasticity of the lengths of sucker rod provides an elastic member with a very significant amount of stretch. The stretch of a very long pumping string may in fact be so great that a short stroke pump at the bottom of the well will not even be operated, all of the movement imparted to the pumping string by a short stroke pumping apparatus at the surface being expanded in stretching the pumping string, leaving insufficient movement at the bottom of the well to operate the pump. For this and other reasons, so-called long stroke pumping units have become more and more popular in recent years. The longer stroke imparted to the rod string by the long stroke pumping unit is sufficient to operate a pump at the bottom of a deep well and the dynamic loading of the pumping string and other apparatus is less.

Rotating drum or winch type long stroke pumping units have come into use in recent years. In these devices a flexible linear power transmitting member extends from the winch or capstan of the pumping apparatus to the pumping string and a second flexible linear power transmitting member, for example, a wire cable, extends from the capstan drum to a counterweight which at least partially balances the weight of the pumping string. As the capstan rotates first in one direction and then in the other, the linear members are alternately wound upon the capstan drum and unwound and the reciprocal movement thus imparted to the linear members is transferred to the pumping string and the counterweight. Pumping units such as described are shown, by way of example in U.S. Pat. Nos. 3,285,081 to Kuhns et al. and 3,640,324 to the present inventor.

Pumping units such as shown in U.S. Pat. No. 3,285,081 to Kuhns et al. depend upon changing dynamic relationships between the relative effective weight of the pumping string and oil in the well tubing and the counterweight to turn the pumping stroke around at the ends of the stroke. The motor driving the apparatus is operated only during the central portion of the pumping stroke, the energization and deenergization of the motor being controlled by limit switches or other control means responsive to the operative position of the pumping string or capstan with respect to the pumping stroke. Such long stroke pumping units permit a very long pumping stroke with low torque and reduce the number of strokes and thus fatigue cycles to lift a given amount of well fluid. Such pumping units also have the advantage of minimum acceleration of the rod and fluid loads.

These long stroke pumping units have still, however, been subject to detrimental oscillations or harmonics in the pumping string, which oscillations interfere with efficient pumping and seriously increase the loading and fatigue in the pumping string, the components of the downhole pump and the above ground pumping apparatus.

SUMMARY OF THE INVENTION

It has now been discovered that the detrimental oscillations and harmonics in the pumping string which have plagued prior long stroke type pumping apparatus as well as short stroke pumping apparatus can be largely obviated by energizing or activating the motor at a particular point in the pumping cycle.

The present invention largely eliminates load induced oscillations in the pumping string by determining with suitable detection or sensing means the load upon the pumping string, and the portion of the pumping cycle in which the pumping string is operating. The load may be conveniently determined by a load cell and the portion of the pumping cycle, i.e. the location and direction of movement of the pumping string, may be conveniently determined with a position sensing device which monitors the angular position of the pumping capstan and the direction of movement of the capstan. A potentiometer coordinated with the rotation of the capstan provides a good source of such a signal. After the stroke of the pumping unit has been turned around at the ends of the stroke by the changing relative weight relationship between the pumping string and the counterweight, the increasing or decreasing load during the upstroke or the downstroke respectively is monitored by readings received from the load cell and at the first detected peak in the increasing or decreasing load the motor of the apparatus is activated. Normally the pumping string will begin an elastic spring back as soon as a peak in the load is attained and if the motor is energized at this point it has been found that the spring back is damped out. By damping out the beginning of the first oscillation by energizing the motor in the opposite direction to the spring back just as the spring back occurs. subsequent oscillations will also be substantially reduced or eliminated. Any suitable electronic, hydraulic or even mechanical logic arrangement can be used to monitor the detection apparatus and energize the motor at the proper times. Alternatively the detection apparatus can be monitored manually, at least for short periods, and the motor energized manually at the proper peak and minimum load values. The motor may be deenergized or deactivated at any convenient detection position of the capstan apparatus by preset limit switches or other suitable control apparatus since the point of deactivation does not have any important bearing upon oscillation or harmonics in the pumping string, but merely upon the efficiency in utilizing the motive power available for operating the pumping apparatus.

Three conditions must in accordance with the invention be fulfilled before activating the pumping apparatus motor either on the upstroke or the downstroke. These three conditions are:

a. The stroke must have ended in one direction.
b. Turnaround of the pumping apparatus must have occurred with motion initiated in the opposite direction.
c. Upstroke load must have reached a maximum value and started to decrease, or downstroke load must have reached a minimum value and started to increase.

Upon the occurrence of each of these conditions in the proper sequence the motor for the pumping apparatus may be started in the direction in which the pumping stroke is already traveling.

DESCRIPTION OF THE PREFERRED EMBODIMENTS

The present inventor has discovered that a large part of the usual harmonics in a long stroke pumping apparatus can be eliminated if the time of energization of the prime mover or pumping apparatus motor is carefully coordinated with the load condition of the pumping string. It has been discovered that if the motor is energized or activated at the point of first maximum or minimum load upon the pumping string just before the load begins respectively to decrease or increase substantially in a temporary oscillation that subsequent oscillations or harmonics in the pumping string are largely eliminated.

Figure 1:
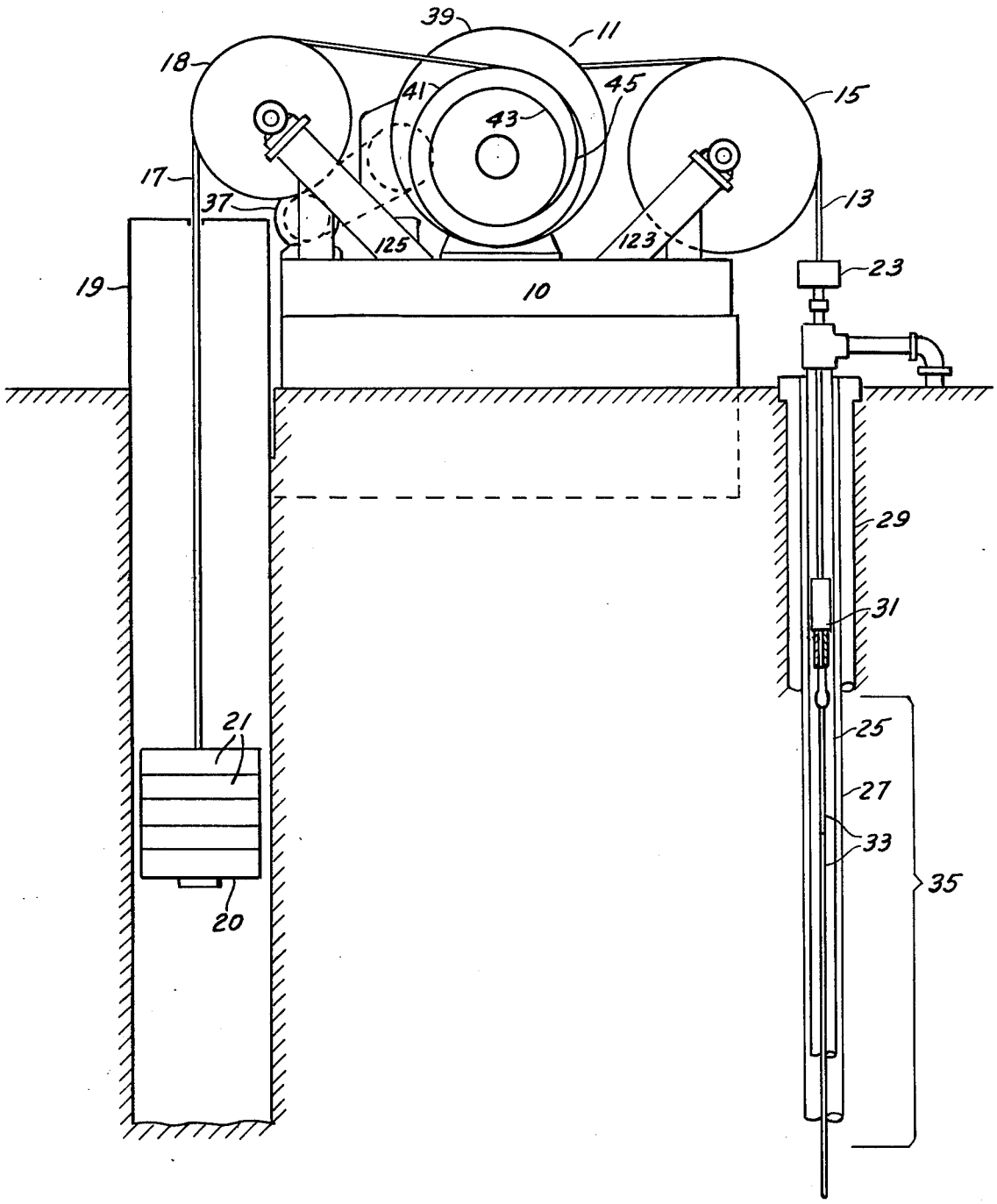
FIG. 1 is a partially cut away view of the general type of pumping apparatus with which the present invention will be useful.

In FIG. 1 there is shown a typical long stroke pumping apparatus of a type with which the present invention is particularly effective. Such a pumping apparatus is shown in more detail in an application entitled "Long-stroke Pumping Apparatus for Oil Wells" filed concurrently with the present application by the present inventor. However, it should not be inferred that the present invention would be useful only for the illustrated type of pumping apparatus as it may be very effectively used with a number of types of apparatus such as, for example, the reversible capstan apparatus shown in the U.S. Pat. Nos. 3,285,081 and 3,640,342 mentioned previously or even in a large walking beam apparatus such as in frequently used in oil well pumping.

FIG. 1 shows a partial cross-section of a rotating capstan type pumping apparatus mounted upon a base 10 and having a large central reversible capstan 11 with several capstan diameters from which a well cable 13 extends over a large guide sheave 15 and a counterweight cable 17 which extends over a second large guide sheave 18 into a counterweight well 19. A counterweight 20 is secured to the end of the counterweight cable and a series of removable counterweights 21 are supported upon the top of the principle counterweight 20.

The well cable 13 after passing over the guide sheave 15 passes through the well head 23 and into a polished pipe 25 contained within the upper portions of the usual well tubing 27 within the well casting 29. The well cable is secured to the top of a so-called traveling stuffing-box 31 which reciprocates within the polished pipe in time with the movement of the well cable. The so-called traveling stuffing-box is shown in additional detail in the present inventor's previous U.S. Pat. No. 3,640,342.

A series of sucker rods 33 are secured to each other to form a long pumping string 35 attached to the bottom of the traveling stuffing-box 31 and extends down the well tubing 27 to a downhole pump, not shown.

The reversible capstan 11 is powered with a motor 37 through a gear reducer, not shown, during the central portion of the pumping cycle and turns freely with the capstan during the ends of the pumping cycle in both directions.

The capstan 11 has a large diameter drum section 39, two intermediate diameter drum sections 41 on both sides of the large diameter drum 39, only one of which intermediate diameter sections in visible in FIG. 1, and two small diameter drum sections 43 on both sides of the intermediate diameter drum sections, only one of which small diameter drum sections is visible. The large drum section 39 is shown eccentric with the intermediate drum section 41 and has interconnecting surface grooves therewith, and a spiral grooved section 45 is shown leading from the intermediate drum to the small drum. Other arrangements in which the large and small drums are both eccentric with respect to the axis of rotation of the intermediate drums, but tangent at one point to allow the cables to pass from one drum to the other, or in which spiral grooved sections lead from both the large and small drums to the intermediate drums, may be used.

The counterweight cable 17 is shown passing from the front intermediate diameter drum 41 and the well cable as passing from the other or rear intermediate diameter drum, which is obscured in FIG. 1 by the large drum 39. The two cables operate or extend from these intermediate diameter drum sections during the middle or intermediate portion of each up and down pumping stroke. At the end of the pumping stroke one of the cables runs up upon the large central drum diameter 39 while the other runs down upon and extends from one of the small drum sections 43. This changes the relative torque arm applied to the capstan 11 by the respective cables and causes the capstan rotation to reverse.

The motor 37 is arranged to apply power to the pumping apparatus when both the well cable 13 and counterweight cable 17 extend from the intermediate drums 41. Thus as the cables pass from the large and small diameter drums to the intermediate drums a suitable motor energization arrangement activates the motor, and when the cables are just about to pass from the intermediate drums to the small and large drums, the motor will be deactivated. Normally such activation and deactivation would be accomplished by suitable limit switches or other control arrangement coordinated with the pumping stroke or capstan revolutions. The capstan movement may be detected and the motor controlled by a mechanical arrangement in which a rotatable member is turned in unison with the proportional to the capstan movement and mechanically opens and closes the motor switches at the proper times or by an electrical signal generating arrangement such as a potentiometer geared to turn in unison with the capstan and putting out a signal related to the relative position of the capstan.

In the present invention the motor is deactivated in the same manner and at the same time or in any other suitable manner or time as described above, i.e. by limit switches or the like, but the activation or energization of the motor is initiated only when the following conditions are fulfilled:

a. The pumping stroke has ended in one direction,
b. turnaround has occurred with motion initiated in the opposite direction, and
c. the load on the pumping string has reached either a maximum value and just started to decrease (on the upstroke) or has reached a minimum value and just started to increase (on the downstroke).

Stated briefly, the invention requires that the motor be activated only after turnaround at both ends of the stroke has occurred and a maximum load or minimum load has been detected on the upstroke and downstroke respectively together with just the beginning of either decrease or increase in the load. When the motor is activated at this point the oscillations or harmonics usually generated by the elasticity of the pumping string are substantially damped out providing a very smooth and even load and pumping stroke.

The present inventor carefully analyzed the action of pumping strings. As a result of this analysis the reason why activation of the motor at the particular load condition in accordance with the invention decreases harmonics in the pumping string and load condition of the well is believed to be as follows.

Since the rod string or pumping string constitutes an elastic member the application of the load of the fluid on the upstroke to the constant load of the rod string itself and the dynamic loads generated by the motion of the rod string cause it to act as a spring, stretching when loads are applied and shrinking when loads are removed. All springs, furthermore, have a resonant or fundamental frequency.

Figure 2:
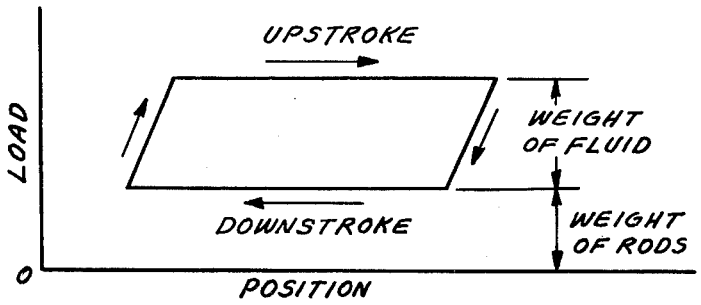
FIG. 2 is a load-position diagram such as is shown in the usual dynamometer card and shows the shape of such a load-position diagram if the pump apparatus was going so slowly that no dynamic forces were imposed and no harmonics were generated in the pumping string.

In FIG. 2 there is shown a load-position diagram of the normal pumping loads which would occur if the pumping apparatus were going so slowly that no dynamic forces are imposed and no harmonics are generated in the rod string. It will be recognized that FIG. 2 is the traditional idealized representation of the well known dynamometer card read out and represents a condition of complete equilibrium.

Figure 3:
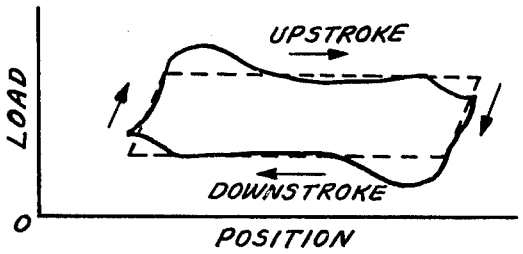
FIG. 3 shows the load-position diagram of the pumping loads if only dynamic loads caused by acceleration appeared in the system.

FIG. 3, on the other hand, shows in solid lines superimposed over a dotted outline of the equilibrium condition shown in FIG. 2 a load-position diagram of the pumping loads which would be registered if only dynamic loads caused by the acceleration of the physical laods are added to the diagram or system. These added dynamic loads are generated by the acceleration at the start of the upstroke or downstroke and deceleration at the end of the upstroke or downstroke.

If it is now imagined that the static and dynamic loads are being lifted by a spring with some intrinsic harmonic frequency, it will be recognized that the spring once disturbed will tend to oscillate back and forth at a rate determined essentially by the length of the spring and the material from which it is made. The disturbing forces generated by the pumping system, the dynamic forces and the motion of the pumping unit will act to cause the spring to bounce or oscillate at its intrinsic fundamental frequency. If the imposed loads and forces coincide with the natural frequency of the pumping string, the amplitude of the bounce will be greatly magnified and all the maximum loads will be increased.

Figure 4:
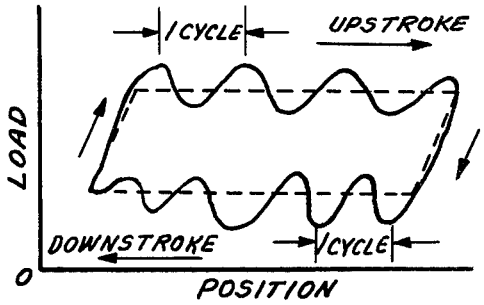
FIG. 4 shows the effects of harmonics only as applied to the basic load diagram.

FIG. 4 shows in solid lines superimposed over a dotted outline of the equilibrium condition shown in FIG. 2 the effects of harmonics only as applied to the basic load diagram. The only disturbing force is the application and removal of the fluid load during the normal pumping action. This load disturbs the spring when the load is added or removed and the rod string bounces at its natural frequency.

In winch or capstan type pumping units the motion of the capstan drum is not continuous in one direction, but reverses as the reciprocation of the pumping string reverses. In reversing winch type units such as shown in FIG. 1 the reversal is initiated by the use of cams or other devices to change the effective radius of the drum with respect to the counterbalance and the well string. This provides an alteration in the torque relationship and generates an opposing torque to stop the unit and start motion in the opposite direction. In such units, the input from the prime mover is stopped near the end of the stroke.

It is possible to re-apply input of energy to the system from the prime mover in the opposite direction at any time. The present inventor has found, however, that there is only one particular time which will give the most desirable results. It has been discovered that energization of the prime mover at other times adds to the problem, or, in a very real sense, is the problem which causes oscillations in the pumping string and load.

Figure 5:
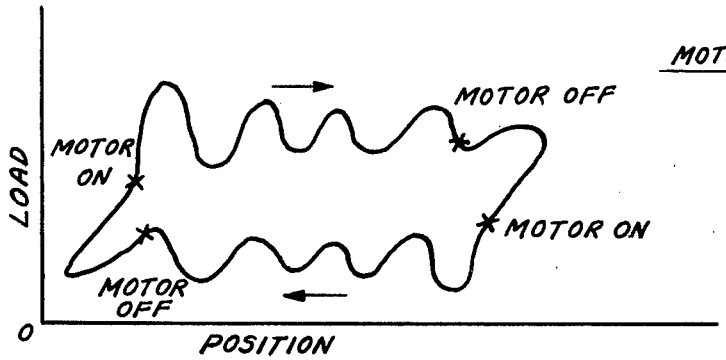
FIG. 5 shows the type of undesirable oscillations in the pumping string if the motor is activated too early in the pumping cycle.
Figure 6:
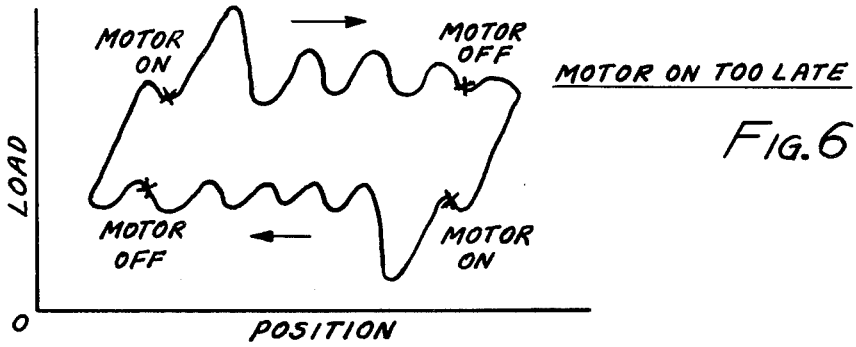
FIG. 6 shows the type of undesirable oscillations which will occur if the motor is activated too late.

FIGS. 5 and 6 illustrate what happens when the prime mover input occurs either too early or too late. When input starts too early as shown in FIG. 5, rapid acceleration of the pumping string causes a severe disturbing motion. This disturbing motion causes larger than normal inertial forces and these abnormal loads generate very large oscillations and loads in the pumping string.

When input is applied too late as shown in FIG. 6, the normal return motion or oscillation has started to slow down and the input of the prime mover causes a rapid acceleration. This causes a further disturbance and an even greater magnification and disturbance of, or oscillations in, the spring constituted by the pumping string.

The abnormal load conditions illustrated in FIGS. 5 and 6 require greater torque from the prime mover and gear reducer. In addition, abnormal and detrimental fatigue forces and cycles are imposed on the component sucker rods or pumping strand of the pumping string and also upon the pumping apparatus.

Figure 7:
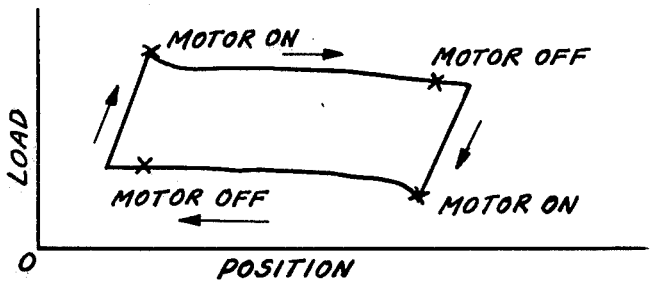
FIG. 7 shows the general idealized shape of the load-position diagram obtained if the teachings of the present invention are followed.

The present inventor has discovered that these two undesirable conditions can be avoided by energizing the prime mover at or near the point of initial peak load or minimum load as illustrated in FIG. 7. When the load has reached its maximum at the beginning of the upstroke, the spring constituted by the pumping string has had its maximum disturbance, and the bounce of the "spring" would cause the load to start to diminish. If the motor is started at this instant, however, the accelerating motion causes the load to increase. These two forces, i.e. the spring back caused by the recoil of the pumping strand and the acceleration caused by the starting of the motor, act in opposite directions and they tend to cancel each other out. The bounce wave in the rod string or pumping string is consequently damped and the load is maintained at a minimum value rather than oscillating wildly.

Likewise when the load has reached its minimum value at the beginning of the downstroke, the "spring" has undergone its disturbance and the bounce of the spring would cause the load to increase. If the motor is started at this instant the accelerating motion causes the load to diminish rather than increase. Again the two forces act in opposite directions and tend to cancel each other. Again the bounce wave in the rod string is damped out and the load is maintained at a minimum value rather than oscillating wildly.

The proper time to initiate energization is further complicated by the many variables in a pumping system. The greatest variable is usually the fluid being pumped. When pumping is first started the fluid is standing high in the casing annulus. As pumping proceeds the fluid level is lowered. If the well is overpumped, the pump does not fill completely and a fluid pound occurs. Various amounts of gas, oil, and water flow into the well bore on an intermittent basis. Each of these changes affects the load diagram. In addition, the inertia of the various components of the pumping unit change from model to model and necessary operational changes in counterbalancing and drive ratios further affect the operation of the unit. While the best time to energize the motor can thus be determined for any given condition of the well and suitable means such as limit switches or other control means can be set to energize the motor at the best point in the pumping cycle as thus determined, changing conditions in the well which may alter the best point for energization make it desirable that the time of energization be altered at least periodically either manually or automatically.

While it would be possible for an operator to monitor the position of the capstan with respect to the pumping cycle and the load on the apparatus through suitable detecting apparatus and read out gauges, and then initiate energization of the motor either completely manually or by alteration of preset limit switches or the like, the fact that pumping units are usually unattended makes such a course of action, while possible in certain temporary circumstances during emergencies or testing, quite impractical for sustained operation. It is thus very desirable to have a control means which will continuously monitor the apparatus and change the point of energization of the prime mover either periodically, or more preferably still, continuously as conditions change.

Thus if the motor or prime mover is started at the proper instant in the cycle of the pumping apparatus for the dynamics of the well and the dynamics of the total pumping unit with its prime mover, the acceleration of the pumping unit and the disturbing forces generated by the pick up or release of the fluid load will substantially cancel each other. Since the wave motion is damped out, the wave excursion is dramatically reduced both in magnitude and quantity.

In order to practice the invention it is necessary to have a suitable means to detect the position of the capstan of the pumping apparatus and a means to detect the load upon the system. Then, when it is determined that turn around at the end of a stroke has occurred and a peak or minimum load has been attained depending upon whether the stroke is up or down respectively, energization of the motor can be initiated by any suitable device.

Component parts of a suitable control system can operate either electrically, mechanically, pneumatically, hydraulically or by use of any combination of these methods. Those skilled in the control arts will readily be able to devise effective control systems to effect the control functions of the present invention.

Figure 8:
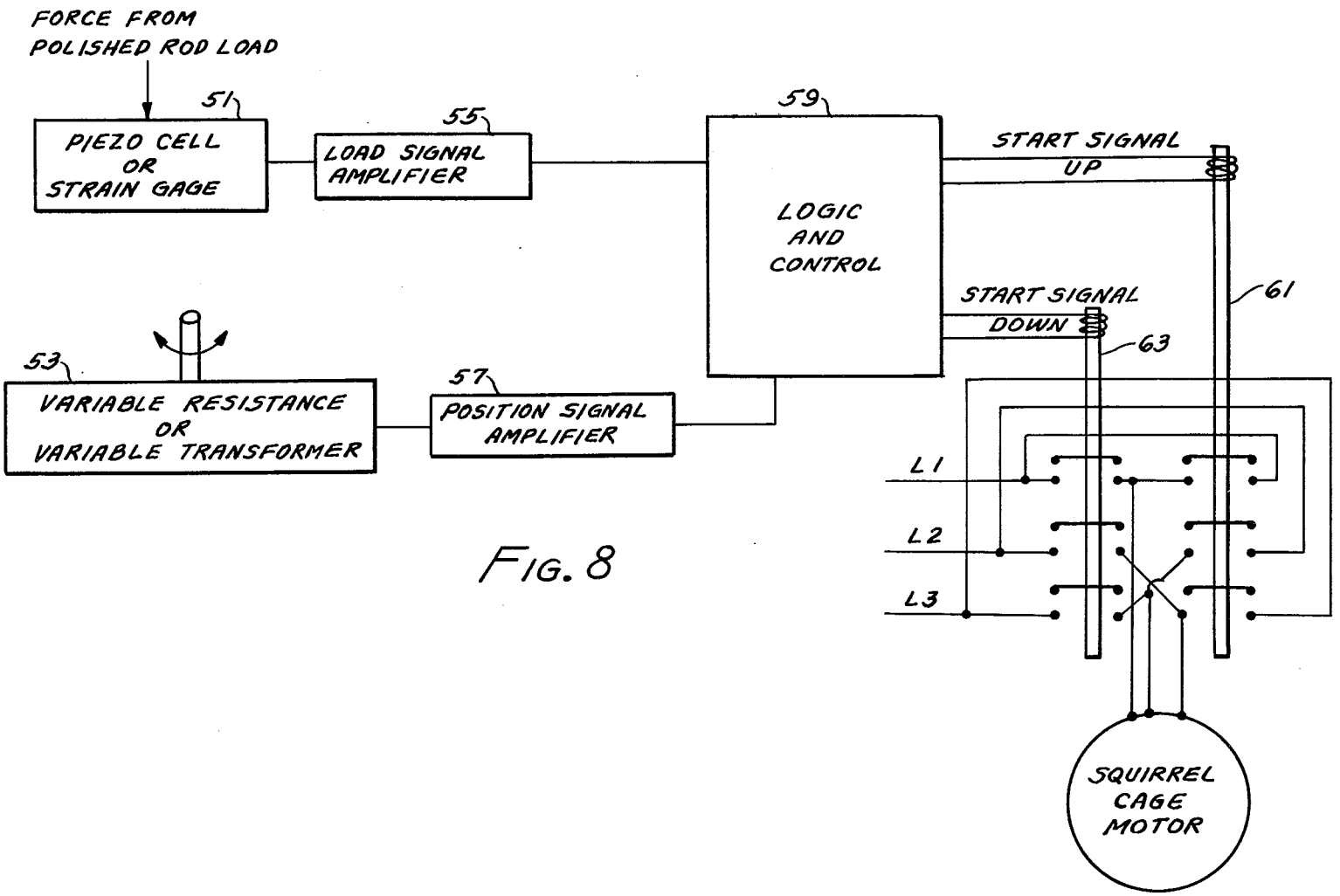
FIG. 8 shows a diagram of a suitable control arrangement for monitoring and controlling the condition of the pumping cycle and the activation of the apparatus motor.

One illustrative control arrangement is shown schematically in FIG. 8. Here a piezoelectric cell or strain gage 51 detects the load upon the pumping string. This may be done my mounting the strain gage on the bearings of the capstan in a position such that strain on the capstan from the pumping strand can be readily detected.

The mechanical position of the capstan can be detected by a variable resistance or variable transformer 53 coupled to the capstan drum shaft. The signals from the strain gage and the position sensor are then amplified in suitable signal amplifiers 55 and 57 and applied to a logic and control unit 59. The logic and control unit 59 may operate electronically or pneumatically or in some other suitable manner. Essentially the control detects the position of the capstan, takes note of and stores the fact that the capstan has reversed direction and detects the load on the capstan or pumping string. When the load reaches a maximum or minimum as determined by the fact that the load then begins either to decrease or increase the control unit compares the position of the capstan to see if this is the first maximum or minimum point after a reversal, and if it is, energizes the prime mover through a solenoid arrangement 61. If desired the control can also be used to deenergize the motor through a second solenoid arrangement 63. The logic and control unit will essentially incorporate discriminator circuits which will continuously compare the strength or other characteristic of the received signals with previously received and temporarily stored signals to detect a reversal in the trend of the signal. When a reversal is noted the conditions of other signals is then compared to see if the three conditions of the invention are fulfilled, namely that the stroke has ended in one direction, that movement has been initiated in the opposite direction and that a load peak or minimum has been attained. If the three conditions are fulfilled the motor is energized. It will be seen that the condition of ending of one stroke and turn around of the pumping stroke may in some cases be considered to be one condition to be detected rather than two.

The most important and detrimental oscillations tend to occur during the upstroke of the apparatus when the maximum well load is on the pumping string. It may, therefore, be desired to control the energization of the prime mover in accordance with the teachings of the present invention only on the upstroke. It will usually be desirable, however, to effect control on the downstroke also, and this is recommended.

It will be evident from the above discussion that the motor can be activated either substantially at the exact maximum or minimum load condition of the pumping stroke or just thereafter. "Just thereafter" can be defined as before more than substantially half of an oscillation in the other direction has occurred and preferably as near the maximum or minimum load as possible so as to attain the optimum damping effect. The time available to apply the motor will depend of course upon the amplitude of the oscillations which would otherwise occur since a longer oscillation will take longer to reach its midpoint. The actual time available for proper energization may thus vary depending upon the length and materials of the pumping string. In each case, however, such energization should take place as near as possible to the maximum or minimum load, depending upon whether the stroke is up or down respectively, to attain maximum damping.

Figure 9:
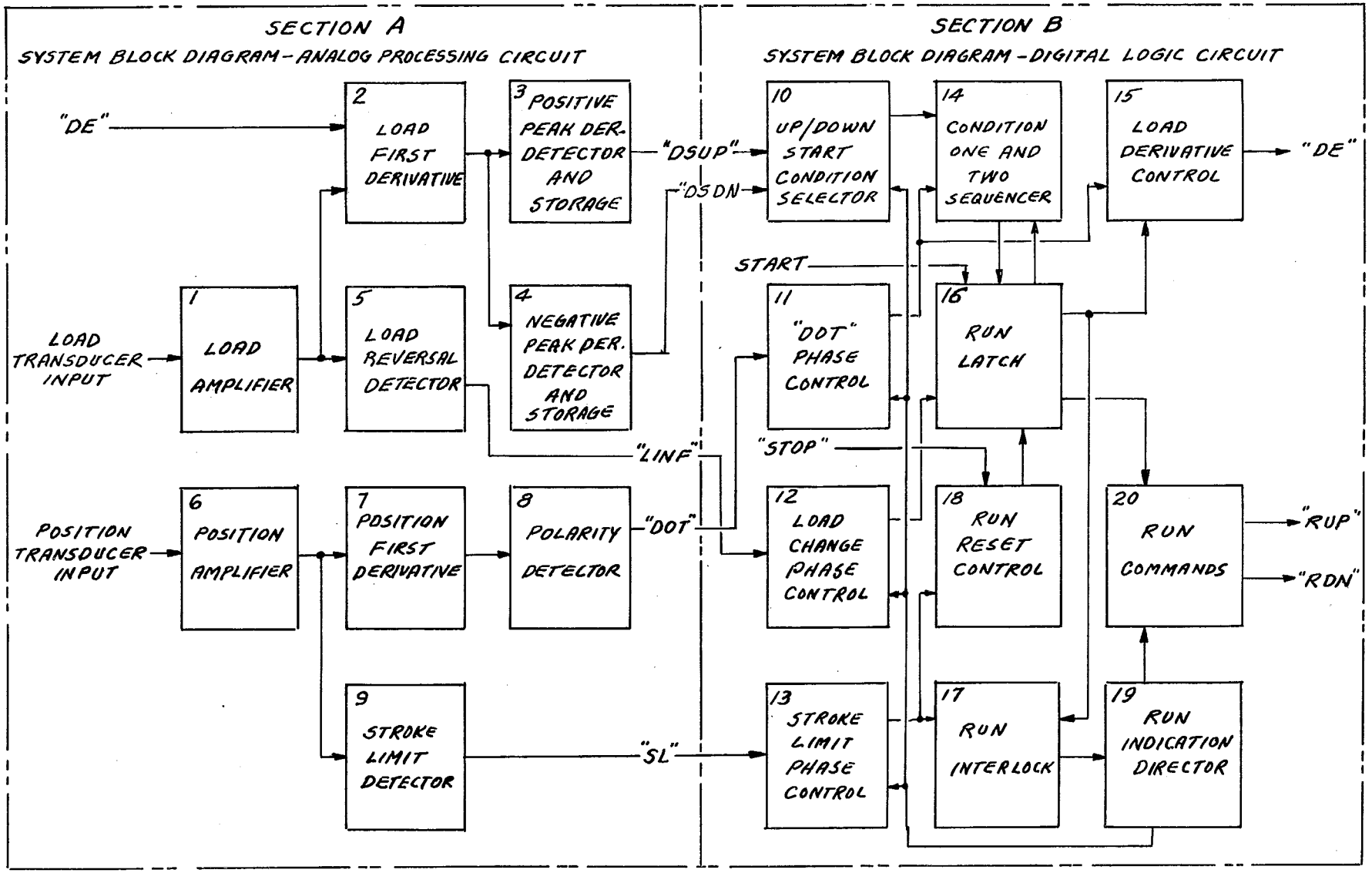
FIG. 9 shows a preferred logic circuit for operating the logic and control function.

In FIG. 9 there is shown schematically one suitable arrangement for the major logic components which would preferably be included in the logic and control unit 59 shown in FIG. 8. The logic arrangement illustrated in FIG. 9 in block diagram form is particularly suitable for use with the winch type capstan unit illustrated in FIG. 1.

Figure 10:
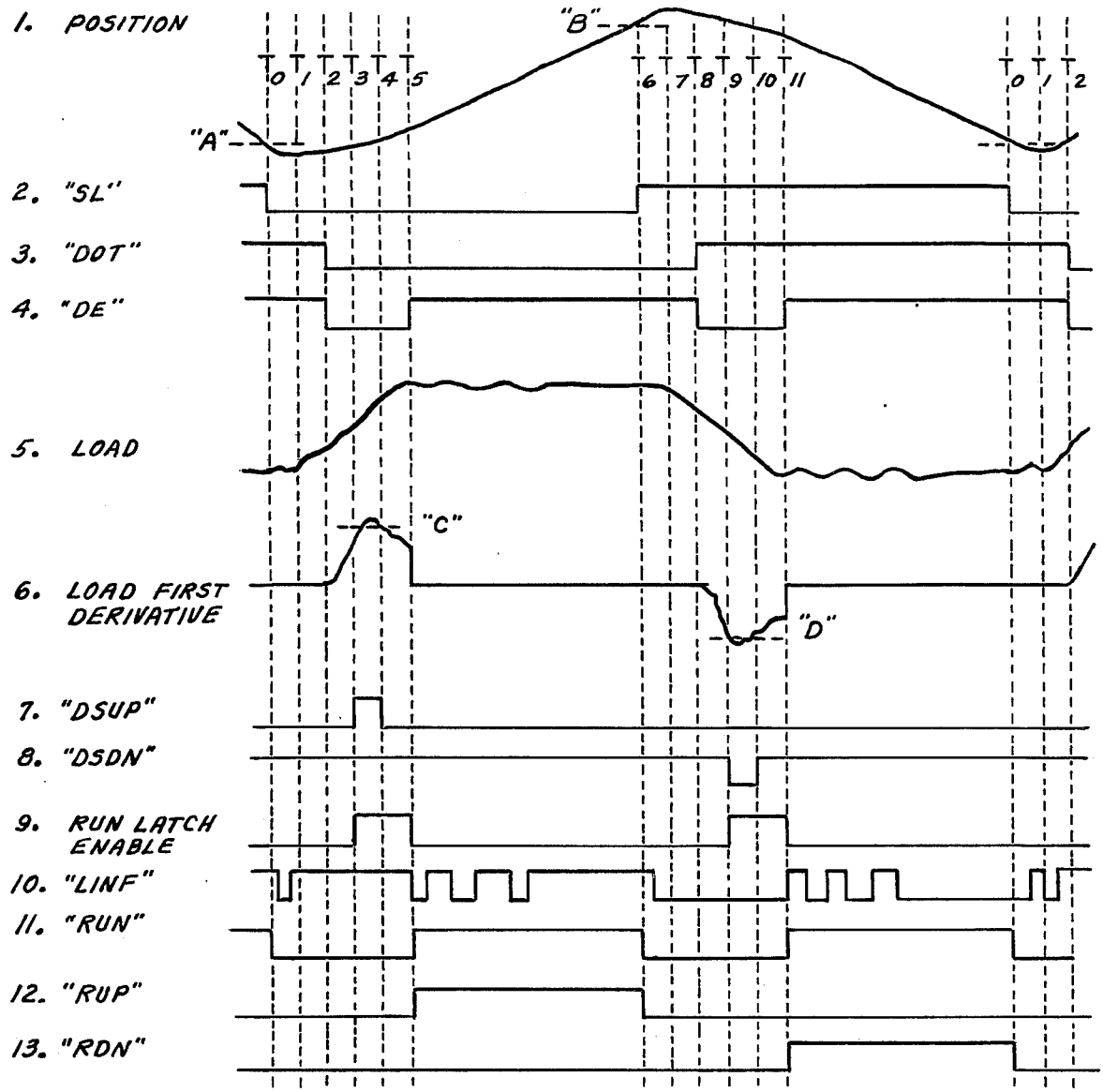
FIG. 10 is a waveform analysis diagram of the principal waveforms of the control apparatus shown in FIG. 9.

The logic control arrangement shown in FIG. 9, which operates with the waveforms shown in FIG. 10, is specifically designed to control the operation of the pumping unit in such a way as to minimize the harmonics generated in the rod string. To accomplish this, the controller performs two major functions: (1) to start the unit at the correct point in the strokes and (2) to stop the motor to allow the unit to coast to the end of the stroke without exceeding maximum stroke limitations. To accomplish these functions two inputs are required from the pumping unit: (1) a load signal representative of the load on the well-side cable and (2) a position signal to indicate the position of the pump. The controller utilizes these two inputs to generate signals which are sequenced by the digital control logic to produce the run commands for the motor.

The control system can be subdivided in two major sections. The first is the analog section which contains the amplifiers and signal conditioners. This is shown in Section A of FIG. 9. The second section is the digital sequence logic which controls the timing and sequencing of the events which must take place to insure proper starting and stopping. This is shown in Section B of FIG. 9.

In the control logic, position of the stroke is used to determine when to stop the motor. After the motor is stopped three conditions must occur in the correct sequence to generate a start command. In chronological order, the first to occur is a signal indicative of direction of travel. This shows that the unit is moving in the proper direction. The second, a significant load change, indicates that the fluid load has transferred valves in the pump. The third condition, a load inflection, indicates that the load has peaked and has begun to decrease at least temporarily. Once the unit has started, it once again travels or operates until a position signal generates an off command to the motor. The start and stop conditions are identical for travel in either the up or down direction except for the inverse nature of the input signals. The sequencing logic is controlled in such a way that it checks the correct polarity of input signals to insure proper starting in either direction.

To further explain the controller operation, the system block diagram, FIG. 9, will be used in conjunction with a series of timing signal waveforms, FIG. 10. The following description will be broken down into separate descriptions of the analog and digital sections, with a final description of the analysis of the signal waveforms and the relationships between them.

ANALOG CIRCUIT DESCRIPTION

As discussed above, the analog section of the logic control has two inputs: a load signal from a transducer mounted either on the bearing mount of the capstan or on the well-side diagonal column of the pumping apparatus and a position signal which may be derived from a tranducer mounted in the position assembly on the gear box and coupled to the capstan drum shaft. These two signals are processed in circuitry outlined in Section A of FIG. 9. The first to be described in the load circuitry which starts with the load amplifier. The output of the load amplifier, Block 1, is input into a first derivative circuit, Block 2, and into a sensitive load reversal detection circuit, Block 5. The load first derivative circuit produces a signal which is proportional to the rate of change in load. This first derivative signal is input into a positive and a negative peak detector and holding circuit, Blocks 3 and 4 respectively. Each circuit produces a pulse output when the derivative amplitude exceeds the threshold stored. As can be seen from the block diagram in FIG. 10, signals abbreviated DSUP and DSDN are the resulting outputs from these peak derivative detectors. It is these two outputs which indicate that a significant load change has occurred on the well-side cable. The tracking and storage feature of these circuits compensates for harmonic variations in the load signal with time, thus insuring proper start points under a wide variety of well conditions.

The output of the load amplifier is also input into a load reversal detector, Block 5. This sensitive circuit produces an output, abbreviated LINF, which is high when the load is increasing and low when the load signal is decreasing. By utilizing LINF in conjunction with the derivative start signals, it is possible for the operation control logic to determine the first load inflection following fluid load transfer in the pump. It is this point in the load waveform that produces the optimum starting condition for minimizing harmonics.

The position amplifier signal from Block 6 is input into a position derivative circuit, Block 7, which generates a signal proportional to the rate of change in position. When compared to the neutral axis however, the polarity of this signal indicates the direction in which the position is changing, i.e. the direction the unit is moving. It is, therefore, the function of the polarity detector Block 8 to produce a direction of travel signal abbreviated DOT. The position amplifier also inputs into a stroke limit detector, Block 9. The output of the stroke limit detector abbreviated SL is a signal which is low when the unit should be traveling up and high when the unit should be traveling down. This signal changes states at the stop points and thus is a signal which indicates which direction the unit should start when the motor is turned on again. This prevents restarting in the same direction. Note also that it is this signal that the sequencing logic recognizes to initiate a stop command to the motor.

The above signals generated in Blocks 1–9 provide the inputs to the digital sequencing circuit which will be described below. The timing relationships will be explained in the final section on waveform analysis. This will facilitate the understanding of how the logic determines when the motor should start.

DIGITAL SEQUENCING LOGIC DESCRIPTION

The digital sequencing logic can be broken down into eleven blocks as shown in Section B of FIG. 9. The five input signals derived from the Analog Processing Circuit Section (Section A of FIG. 9) described above are input into the four condition selectors and phasers depicted by Blocks 10, 11, 12 and 13. It is the function of these signal selectors and invertors to provide the condition sequencers with the proper polarity of input changes as necessitated by the inverse nature of the signals used to distinguish the upstart point from the downstart point. Blocks 10–13 are controlled by the run direction indicator, Block 19. This indicator retains the "flag" so that the controller knows which direction to run the unit. Block 14, the condition one and two sequencer, first detects a logic one from the DOT phaser, Block 11. This indicates that the unit is now moving in the direction it is desirable to start. Once having condition DOT satisfied, it is necessary to get a pulse from the up-down start condition selector. This pulse is delayed until after condition one is met by the derivative control circuit, Block 15. This circuit disables the load first derivative until the motor is off and the direction of travel is appropriate for the next start. During the time both of these conditions are satisfied, the derivative enable signal, DE, goes low to permit deviation of the load first derivative signal from the neutral axis. When the load derivative deviates sufficiently to indicate a significant load variation, DSUP or DSDN provides a pulse to the condition one and two sequencer, Block 10. With these conditions met, Block 14 provides an enabling signal to the run latch, Block 16. Once this latch is enabled, the next transition of LINF will produce a run command from Block 16. This run command inputs into Block 20, which distinguishes between run up and run down by combining the information from the run direction indicator. Now that the unit is running, it travels until the next transition of the stroke limit detector signal SL. The transition of SL is input to the run reset control Block 18 which in turn resets the run latch and stops the unit from traveling. When the run latch is in the stop position, the run interlock, Block 17, enables the SL signal to togel the run direction indicator. Once the run direction indicator is set in the new state Blocks 10–13 are now programmed to phase the signal input variations for start point detection in the opposite direction.

Two other inputs are provided for the run logic. One is the stop command which is input to Block 18. This input is utilized by the malfunction circuitry and restart circuitry to stop the well if it should be running at the time one of these conditions occurs. The second input is a start signal which inputs directly to the run latch. This start signal is produced by the sequence restart logic for starting at times other than normal run detection.

This completes a general description of the sequence start logic. The following section will explain the waveform diagrams. This explanation of the circuit inputs and outputs will help clarify the above system outline.

WAVEFORM DIAGRAM ANALYSIS

To facilitate explaining the chronological sequence of events that occur during the operation of the controller, 13 waveforms are illustrated in FIG. 10. Note that on these waveforms there are 12 distinct timing increments denoted $T_0$ through $T_{12}$.

Waveform 1 is the position signal which is the output of Block 6. This waveform illustrates the position of the pump plunger or wellstring as a function of time. At time $T_0$ the position waveform crosses threshold A. At this point a motor stop command is initiated by the transition of SL, as shown in Waveform 2. After the motor is shut off, the unit coasts to a stop at point $T_1$ where, due to the mechanical cam arrangement of the power wheel, the unit is accelerated in the opposite direction. At point $T_5$ the motor is started in the up direction and the unit travels at a constant speed until it reaches point $T_6$. As the position signal crosses to a stop at point $T_7$ from which it is accelerated back in the opposite direction. At point $T_{11}$ the motor starts in the down direction. The unit runs at a constant speed until it reaches point $T_0$ from where the cycle just described is repeated.

Waveform 2 is the output of the stroke limit detector circuit, Block 9. Signal SL makes a transition from high to low at point $T_0$ as the position signal crosses threshold A. The signal remains low until the position signal crosses threshold B at which point SL returns high where it remains until time $T_0$ again.

Waveform 3, the direction of travel signal, is high until time $T_2$. At time $T_3$ DOT makes a transition to a low where it remains until time $T_8$ when, as shown in the position signal, the unit is accelerated in the down direction. The signal remains high until time $T_2$ when the unit changes directions and starts up once again.

Waveform 4, the derivative enable signal, is normally high and goes low when both the run signal is low and the unit is traveling in the appropriate direction to start. This is shown from time $T_2$ to time $T_5$ for upstart detection and from time $T_8$ to time $T_{11}$ for downstart detection.

Waveform 5 is the load versus time signal. It is generated by the load amplifier of Block 1. At the downstop, $T_0$, the load is at a minimum value and remains low until time $T_1$ when as the unit starts up the signal begins to increase. Acceleration of the pump plunger and wellstring upward transfers fluid load from the standing valve to the traveling valve of the pump as indicated by the large increase in load shown from $T_2$ to $T_5$. At point $T_5$ the load has peaked and started to drop. This is the indication to the logic circuitry that it is time to start the motor. The load remains high until time $T_7$ when acceleration downward transfers fluid load from the traveling valve to the standing valve as shown by the load decrease from $T_7$ to $T_{11}$. At $T_{11}$ the load has reached a minimum value and begun to increase which is the signal for the controller to start the motor. The load remains low to point $T_1$ at which time the unit reverses directions again causing load transferral.

Waveform 6 is the first derivative of load which is an output proportional to the rate of change in load. Note that this signal remains at the neutral axis until time $T_2$ when the derivative enable signal goes low. At this time, the load derivative signal increases sharply because of the increasing load characteristic in Waveform 5. As the load slows the rate of increase approaching time $T_5$, the load derivative begins to fall back toward the neutral axis. At time $T_5$, the load derivative is forced back to the neutral axis as the derivative enable signal goes high once again. The first derivative of load remains at this neutral axis until time $T_8$ at which time the derivative enable signal goes low once again. The load first derivative begins to decrease because of the decreasing load in Waveform 5. This derivative signal reaches its minimum value and begins to increase as the rate of load decrease slows. At time $T_{11}$, the derivative signal is once again clamped to the neutral axis where it remains until time $T_2$ when the upstart detection is enabled once again.

Waveform 7 is a derivative start up signal, DSUP, which is shown in the diagram as a short positive pulse from time $T_3$ to time $T_4$. Time is the duration of the load first derivative signal above threshold C. DSUP is the indication to the sequence start logic that the fluid load has been tranferred from the standing valve to the traveling valve of the downhole pump.

Waveform 8 is a derivative start down signal, DSDN, which is high at all times except from time $T_9$ to $T_{10}$ while the load first derivative signal is below threshold D. DSDN is the signal to the sequence start logic that the load has been transferred from the traveling valve to the standing valve.

Waveform 9 is the run latch enable signal that is produced by the successful detection of start conditions 1 and2. Once this signal goes high, the next appropriate transition of LINF will clock the run latch to the "run" state.

Waveform 10 is the load inflection signal, LINF, which is indicative of load reversals. Note that these changes occur at many points other than the ones of interest — the ones of interest being at $T_5$ and $T_{11}$. It is the negative transition at $T_5$ that produces a start up command, and the positive transition at $T_{11}$ that produces the start down command. The other transitions of this signal have no bearing on the control of the unit.

Waveform 11 is a run command which is normally low and goes high at times when the motor should be on.

Waveform 12 is a run up command which is high only during the time the motor is on to drive the unit.

Waveform 13 is the run down command which is high only when the motor is on to run the unit down.

The sequential operation of the controller is easier to follow by observing the timing relationships of the waveforms just described. The chronological sequence of events follows. At time $T_0$, the position signal Waveform 1 crosses threshold A. This crossing generates a negative transition of Waveform SL which in turn produces an off command to the motor. The unit then coasts to a stop at point $T_1$ where it is reversed by the cam arrangement of the unit. At time $T_2$, signal DOT makes a transition from high to low to indicate that the unit is traveling up. Simultaneously, the derivative enable signal DE goes low enabling the load first derivative to begin a positive increase. When the load first derivative crosses threshold C, a positive transition in DSUP is generated as shown in Waveform 7. This positive transition completes the comparison check for conditions 1 and 2 and enables the unit to start at $T_5$ with the negative transition of LINF. At time $T_5$, the run and the run up commands are produced simultaneously. At time $T_6$, position waveform crosses threshold B which generates a positive transition in SL. The unit coasts to a stop at time $T_7$ where it begins acceleration in the opposite direction. At time $T_8$ the direction of travel makes the transition from low to high to indicate the unit is now traveling down. This simultaneously produces a derivative enable signal which in turn enables the load first derivative, Waveform 6. At time $T_9$, the first derivative of load crosses threshold B which generates a negative transition of DSDN. This negative transition completes the comparison check for condition 1 and 2 in the sequence start. The unit starts at time $T_{11}$ with the next positive transition of LINF.

While the specific circuit components of the block units used in the logic control diagram shown in FIG. 9, for simplicity, are not shown, any person skilled in the control arts will easily be able by reference to FIG. 9 and in conjunction with FIG. 10 to devise suitable electronic logic circuits from readily available components well known to those skilled in the art in order to practice the invention.

I claim:

1. A method of operating an oil well pumping apparatus in which a prime mover applies motive power to the apparatus only during the central portion of the pumping cycle comprising:

a. determining the maximum load condition of the pumping apparatus during the initial portion of each upstroke of the apparatus, and b. energizing the prime mover means immediately after the maximum load condition has occurred.

2. A method according to claim 1 additionally comprising:

c. determining the minimum load condition of the pumping apparatus during the initial portion of each downstroke of the apparatus, and d. energizing the prime means immediately after the minimum load condition has occurred.

3. A method according to claim 2 in which the pumping apparatus is a reversible capstan type apparatus in which reversal is accomplished by varying the relative mechanical advantage of a counterweight relative to the pumping string and additionally:

e. deenergizing the prime mover toward the end of a stroke before the relative mechanical advantage has shifted.

4. A method of operating an oil well pumping apparatus including a pumping string in which a prime mover applies motive power only during the central portion of the pumping cycle comprising:

a. determining during each pumping cycle i. when the downstroke has ended, and ii. turn around of the pumping stroke has occurred with motion initiated in the upstroke direction, and iii. the upstroke load on the pumping string has reached a maximum value and just started to decrease, and b. energizing the prime mover in the direction of the upstroke when the three conditions of subparagraph (a) have occurred.

5. A method according to claim 4 additionally comprising:

c. determining during each pumping cycle, i. when the upstroke has ended, and ii. turn around of the pumping stroke has occurred with motion initiated in the downstroke direction, and iii. the downstroke load on the pumping string has reached a minimum value and just started to increase, and d. energizing the prime mover in the direction of the upstroke when the three conditions of subparagraph (c) have occurred.

6. In an oil well pumping apparatus, control means for initiating operation of a prime mover to drive said apparatus comprising:

a. first means to determine when the downstorke has ended, b. second means to determine when turn around has occurred and motion has been initiated in the upstroke direction, c. third means to determine when a maximum load value has occurred and the load has just started to decrease, and d. fourth means to energize the prime mover in the upstroke direction when each of the first, second and third means have detected their respective events.

7. The oil well apparatus of claim 6 additionally comprising:

e. fifth means to determine when the upstroke has ended, f. sixth means to determine when turn around of the pumping apparatus has occurred and motion has been initiated in the downstroke direction, g. seventh means to determine when a minimum load value has occurred and the load has just started to increase, and h. eighth means to energize the prime mover in the downstroke direction when each of the fifth, sixth, seventh and eighth means have detected their respective events.

8. In an oil well pumping apparatus including a pumping string and a prime mover energized during only the central portion of the pumping cycle, means for initiating operation of the prime mover comprising:

a. means to continuously detect the position of the pumping string with respect to the pumping cycle, b. means to continuously detect the load upon the pumping apparatus, c. means to detect the occurrence of the following conditions in the pumping cycle, i. when the pumping stroke has ended in the downward direction, turn around has occurred and motion has been initiated in the upward direction, ii. when a maximum load has occurred and the load has just started to decrease, and d. means to energize the prime mover in the upstroke direction when the conditions of subparagraph (c) have been detected.

9. In an oil well apparatus according to claim 8 additional means comprising:

e. means to detect the occurrence of the following conditions in the pumping cycle, i. when the pumping stroke has ended in the upward direction, turn around has occurred and motion has been initiated in the downward direction, ii. when a minimum load has occurred and the load has just started to increase, and f. means to energize the prime mover in the downstroke direction when the conditions of subparagraph (e) have been detected.

* * * * *

UNITED STATES PATENT OFFICE
CERTIFICATE OF CORRECTION

PATENT NO. : 4,062,640

DATED December 13, 1977

INVENTOR(S) : Robert H. Gault

It is certified that error appears in the above-identified patent and that said Letters Patent are hereby corrected as shown below:

Col. 1, line 24, "expanded" should read --expended--.

Col. 1, line 48, "3,640,324" should read --3,640,342--.

Col. 2, line 48, "detection" should read --detected--.

Col. 4, line 11, "casting" should read --casing--.

Col. 4, line 30, "in" of first occurrence should read --is--.

Col. 5, line 4, "the" should read --and--.

Col. 8, line 13, "my" should read --by--.

Col. 9, line 22, "strokes" should read --stroke--.

Col. 10, l-ne 7, "in" should read --is--.

Col. 12, line 3, after the word "crosses" the following has been omitted --threshold "B", the motor is shut off. The unit coasts--.

Col. 12, line 68, "Time" should read -- This --.

UNITED STATES PATENT OFFICE

CERTIFICATE OF CORRECTION

PATENT NO. : 4,062,640

DATED December 13, 1977

INVENTOR(S) : Robert H. Gault

It is certified that error appears in the above-identified patent and that said Letters Patent are hereby corrected as shown below:

Col. 14, claim 2, subparagraph (d), line 18, after the word "prime" insert the word --mover--.

Col. 14, line 60, claim 6, subparagraph (a) the word "downstorke" should read --downstroke--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*